United States Patent [19]

Sorenson

[11] Patent Number: 4,902,552

[45] Date of Patent: Feb. 20, 1990

[54] REINFORCED DRY LAID FIBROUS WEBS

[75] Inventor: Wayne P. Sorenson, Appleton, Wis.

[73] Assignee: James River-Norwalk, Inc., Norwalk, Conn.

[21] Appl. No.: 267,345

[22] Filed: Nov. 4, 1988

Related U.S. Application Data

[62] Division of Ser. No. 723,863, Apr. 16, 1985, Pat. No. 4,806,190.

[51] Int. Cl.[4] ..... D06H 7/04

[52] U.S. Cl. ..... 428/152; 428/284; 428/293; 428/297; 428/298

[58] Field of Search ..... 428/232, 238, 239, 284, 428/293, 297, 298, 152

[56] References Cited

U.S. PATENT DOCUMENTS

| | | | |
|---|---|---|---|
| 3,597,299 | 8/1971 | Thomas et al. | 428/152 |
| 3,645,836 | 2/1972 | Torr | 428/293 |
| 3,695,985 | 10/1972 | Brock et al. | 428/152 |
| 3,726,750 | 4/1973 | Stillings | 428/293 |
| 4,198,460 | 4/1980 | Kiss | 428/284 |

*Primary Examiner*—James J. Bell

*Attorney, Agent, or Firm*—Finnegan, Henderson, Farabow, Garrett & Dunner

[57] ABSTRACT

A method and apparatus for making reinforced, dry laid fibrous web. A first layer of dry cellulosic fibers is laid on a forming wire. A plurality of yarns maintained under tension are applied to the first layer of dry cellulosic fibers. The tension on the bulked yarns is released upon application of the yarns to the first layer of dry cellulosic fibers to form relaxed, bulked yarns. A second layer of dry cellulosic fibers is laid on the first layer of dry cellulosic fibers and relaxed, bulked yarns.

8 Claims, 5 Drawing Sheets

REINFORCED DRY LAID FIBROUS WEBS

This is a division of application Ser. No. 723,863, field Apr. 16, 1985 now U.S. Pat. No. 4,806,190.

BACKGROUND OF THE INVENTION

The present invention relates generally to the manufacture of fibrous webs and, more particularly, to a method and an apparatus for making a reinforced, dry laid fibrous web.

A dry or air laid mat of cellulosic fibers typically exhibits relatively low strength and low stretch characteristics. As a result of these low strength and stretch characteristics, the mat is relatively difficult to process in subsequent paper making steps. Typically, the final air or dry laid cellulosic product also possesses these low strength and stretch characteristics. As a result, the present inability of the art to achieve the desired strength and stretch properties in the final dry laid, fibrous web product often limits the use of the web product.

Various techniques have been proposed to attempt to remedy these low strength and stretch properties in dry laid fibrous webs. These techniques include the addition of water to the web for the hydrogen bonding of the fibers, the inclusion of a scrim within the web, and the addition of thermoplastic bonding materials to the web.

Although these techniques may improve somewhat the strength and stretch characteristics of a dry laid fibrous web, these techniques typically do not increase the bulk of the web. The lack of bulkiness in the web product inhibits the use and marketability of the web product. Consumers and commercial users generally desire a web product that provides bulk, as well as strength and stretchability. Typically, bulk in a web product enhances the absorbency and liquid holding capacity of the web product in comparison to a relatively non bulky web product. Moreover, consumers and commercial users usually prefer the handling or feel of a relatively bulky web product. When the web product is used as a tissue, towel, wiper, or other simulated cloth-like material, it is especially desirable for the web product to possess bulk as well as strength and stretchability.

As noted, present techniques do not necessarily yield a dry laid fibrous web that has all of these various properties. For example, the insertion of a scrim into a web does not necessarily improve the bulk or stretch characteristics of the web product, even though the web may be slightly stronger.

Similarly, the addition of an adhesive or cohesive bonding agent to the web product may enhance the strength of the web product, but bonding is difficult to perform effectively and does not necessarily increase the bulk of the web. For example, when the adhesive or cohesive bonding agent is added to the web, care must be taken to insure that the cellulosic web is not bonded to the forming wire and that the forming wire is not contaminated by the bonding agent.

SUMMARY OF THE INVENTION

It is therefore a goal of the present invention to produce a reinforced, dry laid fibrous web having improved strength, stretchability and bulk.

It is also a goal of the present invention to provide a method of making a reinforced, dry laid fibrous web in an efficient and relatively easy manner.

Additional goals and advantages of the present invention will be set forth in part in the description that follows and in part will be taught by the description, or may learned by practice of the invention. Goals and advantages of the invention may be realized and obtained by means of instrumentalities and combinations particularly pointed out in the appended claims.

To achieve these goals, and in accordance with the purpose of the invention, the present invention provides a method of making a reinforced, dry laid fibrous web comprising the steps of: (a) laying a first layer of dry cellulosic fibers on a forming wire means; (b) applying a plurality of yarns maintained under tension to the first layer of dry cellulosic fibers; (c) releasing the tension on the yarns upon application to the first layer of dry cellulosic fibers to form relaxed, bulked yarns; and (d) laying a second layer of dry cellulosic fibers on the first layer of dry cellulosic fibers and relaxed, bulked yarns.

The present method and apparatus produce a reinforced, dry laid fibrous web. This web comprises (a) one or more layers of dry cellulosic fibers; and (b) a plurality of relaxed, bulked yarns dispersed within the layers of the dry cellulosic fibers to reinforce the strength of the layers and to increase the absorbency of the web.

The present invention also provides an apparatus for making a reinforced, dry laid fibrous web. The apparatus comprises: (a) a means for laying a first layer of dry cellulosic fibers on a forming wire means; (b) a means for applying a plurality of yarns maintained under tension to the first layer of dry cellulosic fibers; (c) a means for releasing the tension on the yarns upon application to the first layer of dry fibers to form relaxed, bulked yarns; and (d) a means for laying a second layer of dry cellulosic fibers on the first layer of dry cellulosic fibers and relaxed, bulked yarns.

The present invention overcomes the various problems associated with previous web forming techniques, and achieves the various goals of the invention. Particularly, the present invention provides a reinforced, dry laid fibrous web that exhibits strength, stretchability, and bulk. The reinforced, dry laid fibrous web product of the present invention has numerous commerical and consumer uses as a result of its strength, stretchability, and bulk. Moreover, the web of the invention can be formed in a relatively easy and efficient manner.

The plurality of relaxed, bulked yarns dispersed within the layers of the dry cellulosic fibers reinforce the dry laid fibrous web and provide interstices in the web. The interstices are pockets in the web that can hold liquid and, hence, increase the liquid absorbency of the web. In addition to enhancing the absorbency, the relaxed, bulked yarns also strengthen the fibrous web. Moreover, the relaxed, bulk yarns still allow for a significant degree of web stretchability.

The foregoing and other goals, features, and advantages of the present invention will be made more apparent from the following description of the preferred embodiments.

BRIEF DESCRIPTION OF THE DRAWINGS

The accompanying drawings, which are incorporated in and constitute a part of the specification, illustrate various embodiments of the invention and, together with a description, serve to explain the principles of the invention.

DETAILED DESCRIPTION OF THE PREFERRED EMBODIMENTS

The present invention provides a method for making a reinforced, dry laid fibrous web. In accordance with the present invention, a first layer of dry cellulosic fibers is laid on a forming wire means. A plurality of yarns maintained under tension are applied to the first layer of dry cellulosic fibers. The tension on the yarns is released upon application of the yarns to the first layer of dry cellulosic fibers to form relaxed, bulked yarns. A second layer of dry cellulosic fibers is then laid on the first layer of dry cellulosic fibers and relaxed, bulked yarns.

Figure 1:
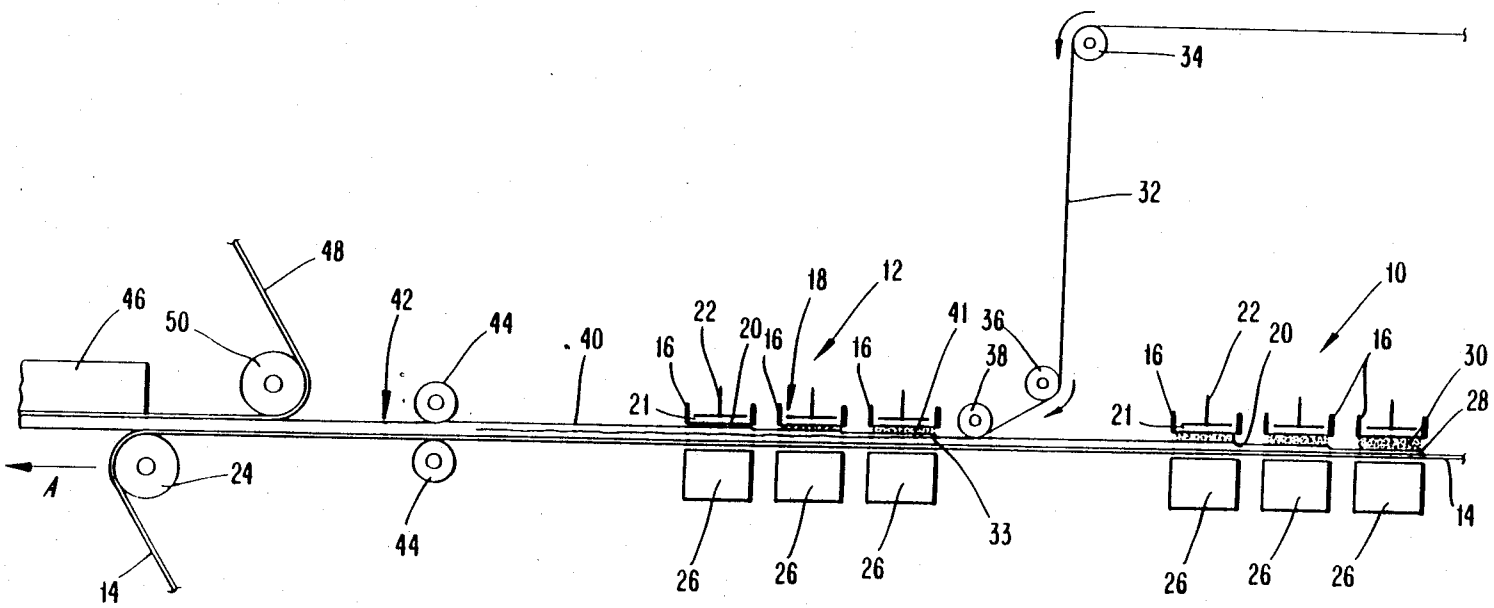
FIG. 1 is a schematic view of the method and apparatus of the present invention.

Reference will now be made in detail to the embodiments of the invention that are illustrated in the accompanying drawings. In FIG. 1, two sets of serially arranged dry fiber distributors 10 and 12 are positioned above a forming wire 14. Each set of serially arranged dry fiber distributors 10 and 12 has one or more fiber distributors 16.

Each dry fiber distributor 16 has a housing 18 that includes a screen 20 extending over a lower opening 21 of the housing 18 and one or more impellers 22 within the housing 18. The impellers 22 in each dry fiber distributor 16 forces the fibers that have been introduced into the housing 18 through the screen 20 and onto the forming wire 14. A typical dry fiber distributor is shown in U.S. Pat. No. 4,014,635.

The forming wire 14 extends beneath the two sets of dry fiber distributors 10 and 12 to receive the fibers distributed by each dry fiber distributor 16. The forming wire 14 is endless and is supported on suitably mounted rollers, such as rollers 24. In FIGS. 1–2 and 5–7, the forming wire 14 is linearly movable from right to left as indicated by directional arrow A.

Various vacuum boxes 26 are positioned under the forming wire 14 beneath each dry fiber distributor 16 to draw and hold the distributed fibers onto the forming wire 14. Various vacuum boxes known in the art, such as those described in U.S. Pat. No. 4,482,308 to Johnson, can be used.

In accordance with the present invention, a first layer of dry cellulosic fibers is laid on a forming wire means. As embodied herein and shown in FIG. 1, the first set 10 of dry fiber distributors 16 lays a first layer 28 of dry cellulosic fibers 30 on a forming wire 14. Various types of cellulosic fibers known in the art, such as wood pulp fibers, can be used.

Examples of wood pulp fibers include various mechanical and chemical pulp fibers, such as cedar fibers, southern pine fibers, spruce fibers, and hemlock fibers. The dimensions of the cellulosic fibers and the resulting first layer of cellulosic fibers are selected depending upon the desired size and type of the resulting web product.

In accordance with the present invention, a plurality of yarns maintained under tension are applied to the first layer of dry cellulosic fibers. As embodied herein and shown in FIGS. 1 and 2, a plurality of yarns 32 are maintained under tension and applied to the first layer 28 of dry cellulosic fibers. The plurality of yarns are fed from a source, not shown, over a pair of pulleys 34 and 36 to a roller 38. The pulleys 34 and 36 are arranged and adjusted to maintain a tension on the yarns. The roller 38 is positioned and adapted to apply or lay the strands of the yarn 32 onto the first layer 28 of dry cellulosic fibers.

The amount of tension on the yarns should be sufficient to elongate the yarns and reduce their diameter. One skilled in the art, depending upon the type of yarn used and the desired web product, would be able to select the proper amount of tension for a particular yarn without undue experimentation.

A suitable yarn is one that is capable of being maintained under tension prior to its application to the first layer, but which tends to contract or return to an original, relaxed geometry when the tension is removed. When the tension on the yarn is released, the yarns decrease in length and increase in diameter as they return to their original, relaxed geometry and, thus, they are considered to be bulked. As used herein, the term "relaxed, bulked yarns" refers to a yarn that exhibits this property of returning to its original, relaxed geometry when the tension on the yarn is released.

Preferably, the yarns are made of a polymeric material, such as polypropylene, polyamide, polyester, polyhydrocarbon, polyurethane, polycarbonate, polyacetal, polyacrylic, polyvinyl, polyvinylidene, nylon, or rayon. Particularly useful yarns are made of polymers resistant to relatively high temperatures, such as temperature around 300° C. Examples of such high temperature resistant polymers are polyaramid fibers, such as aromatic polyamides, that are available under the trademarks KEVLAR and NOMEX from DuPont. Typically, the yarns have about 50 to 60 filaments per yarn strand. The filaments are on average about 70 to 100 deniers.

Preferably, the plurality of relaxed, bulked yarns are laid substantially parallel to each other within the first layer of cellulosic fibers. Likewise, the yarns are preferably applied to the first layer in a direction parallel to the direction of movement of the forming wire, as shown by the application of the bulked yarns 32 in a direction parallel to the movement of the forming wire 14 in direction A, as illustrated in FIGS. 1 and 2.

In accordance with the present invention, the tension on the yarns is released immediately upon application of the yarns to the first layer of dry cellulosic fibers to form relaxed, bulked yarns. As embodied herein and shown in FIG. 1, the tension on the yarns 32 is released upon application of the yarns 32 to the first layer 28 of dry cellulosic fibers to form relaxed, bulked yarns 33.

Figure 2:
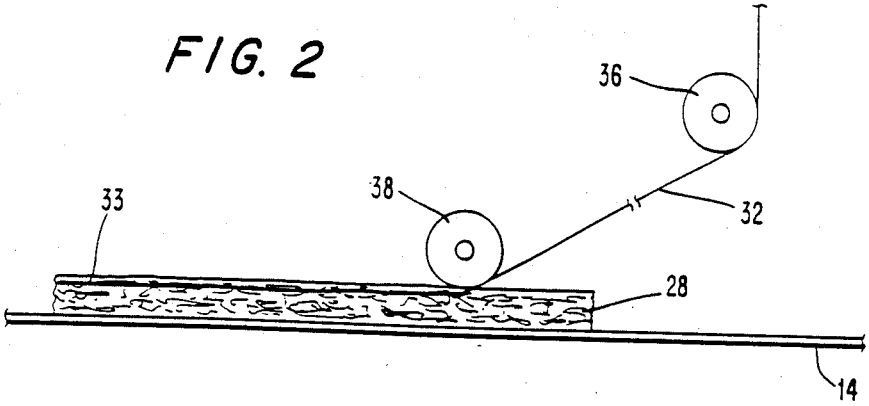
FIG. 2 is an enlarged view of a portion of the method and apparatus shown in FIG. 1.

In the embodiment of FIGS. 1 and 2, the roller 38 releases the tension on the yarns 32 upon application of the yarns 32 to the first layer 28 of dry cellulosic fibers. The roller 38 performs this releasing function when the pulley 36 is driven at a linear speed slightly greater than the linear speed of the roller 38 and the forming wire 14. By releasing the tension on the yarns 32, the yarns return to their original relaxed, bulked condition and thereby enhance the absorbency, strength, and stretchability of the resulting web.

In accordance with the present invention, a second layer of dry cellulosic fibers is laid on the first layer of dry cellulosic fibers and relaxed, bulked yarns. As embodied herein and shown in FIG. 1, a second layer 40 of dry cellulosic fibers 41 is laid on the first layer 28 of dry cellulosic fibers and relaxed, bulked yarns 33. The cellulosic fibers of the second layer 40 are laid by the dry fiber distributors 16 of the second set 12 of dry fiber distributors 16.

Typically, the cellulosic fibers 41 used to form the second layer 40 are of similar composition and dimensions as the cellulosic fibers 30 used to compose the first layer 28 of cellulosic dry fibers. However, cellulosic fibers of other dimensions and compositions can also be used. The second layer 40 of dry cellulosic fibers 41 is of sufficient thickness to cover the relaxed, bulked yarns 33 applied to the first layer 28 of dry cellulosic fibers.

After the second layer 40 of dry cellulosic fibers 41 is laid, the resulting web 42 is passed through a pair of rollers 44 that smooth out and compact the cellulosic fibers forming the web 42. As shown in FIG. 1, the web 42 is then removed from the forming wire 14 by a vacuum box 46 that draws the formed web 42 away from the forming wire 14 and onto an endless conveyor 48, which is moved by various rollers 50.

Figure 5:
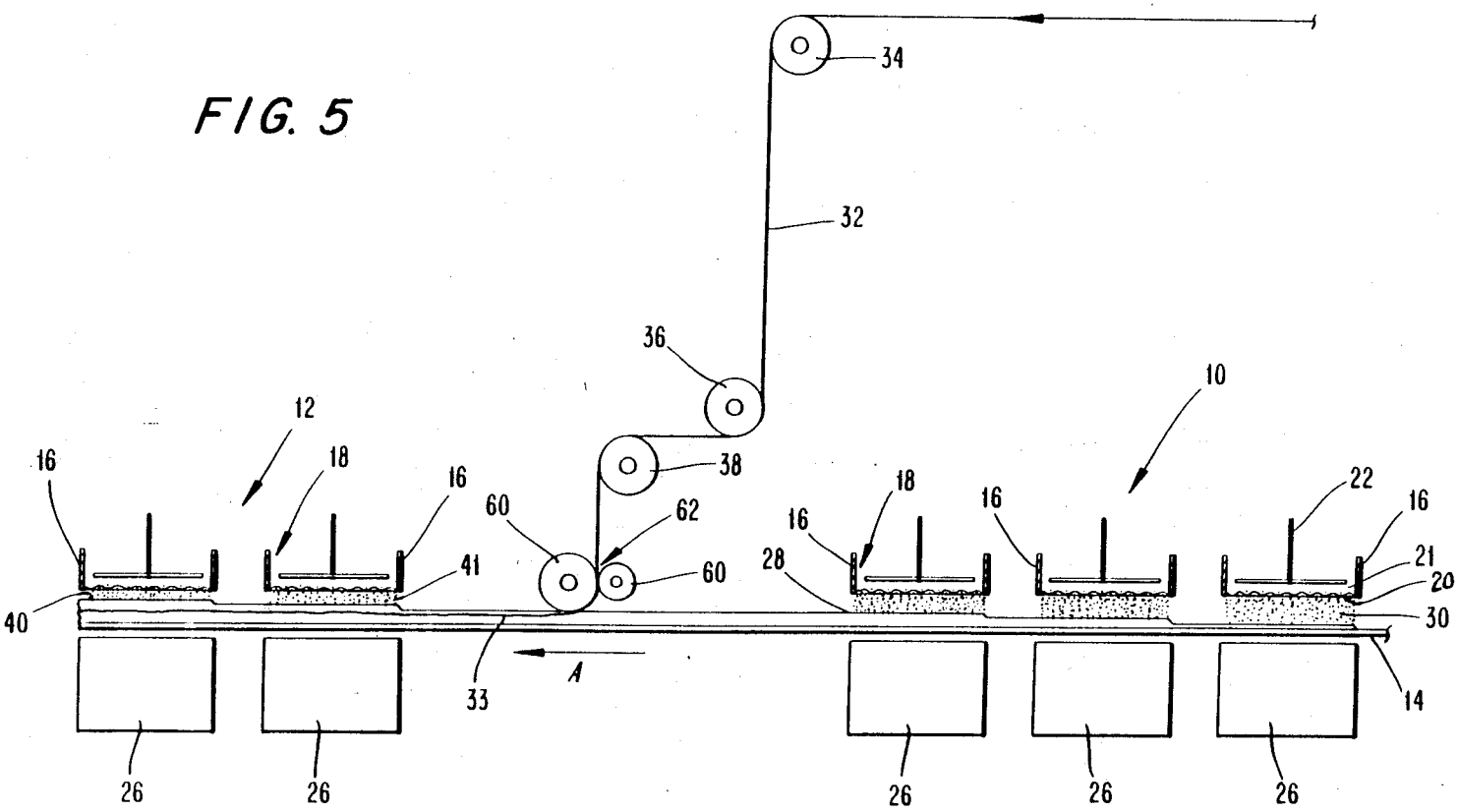
FIG. 5 is a schematic view of an alternative embodiment of the method and apparatus of the present invention.
Figure 6:
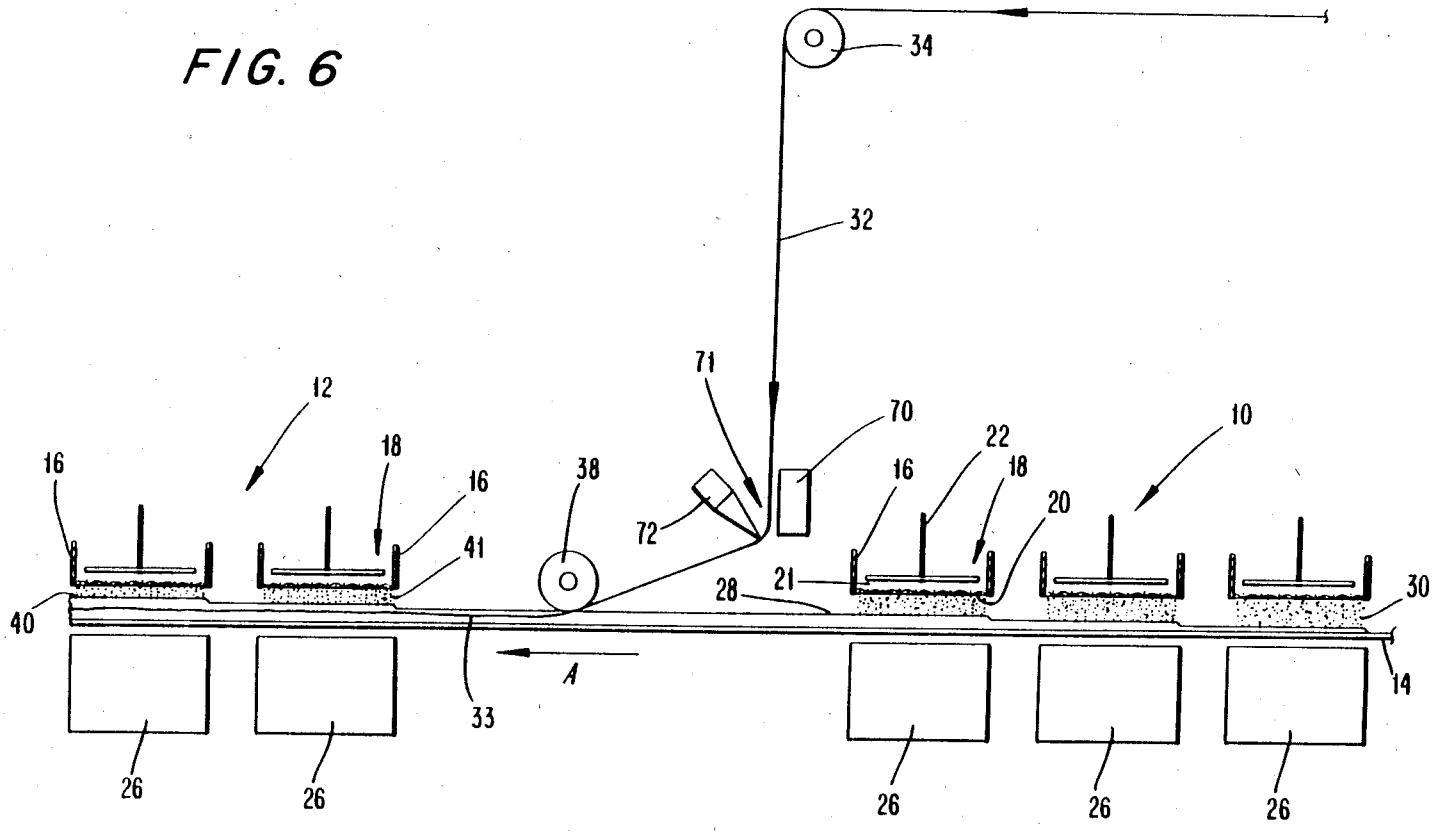
FIG. 6 is a schematic view of another embodiment of the method and apparatus of the present invention.
Figure 7:
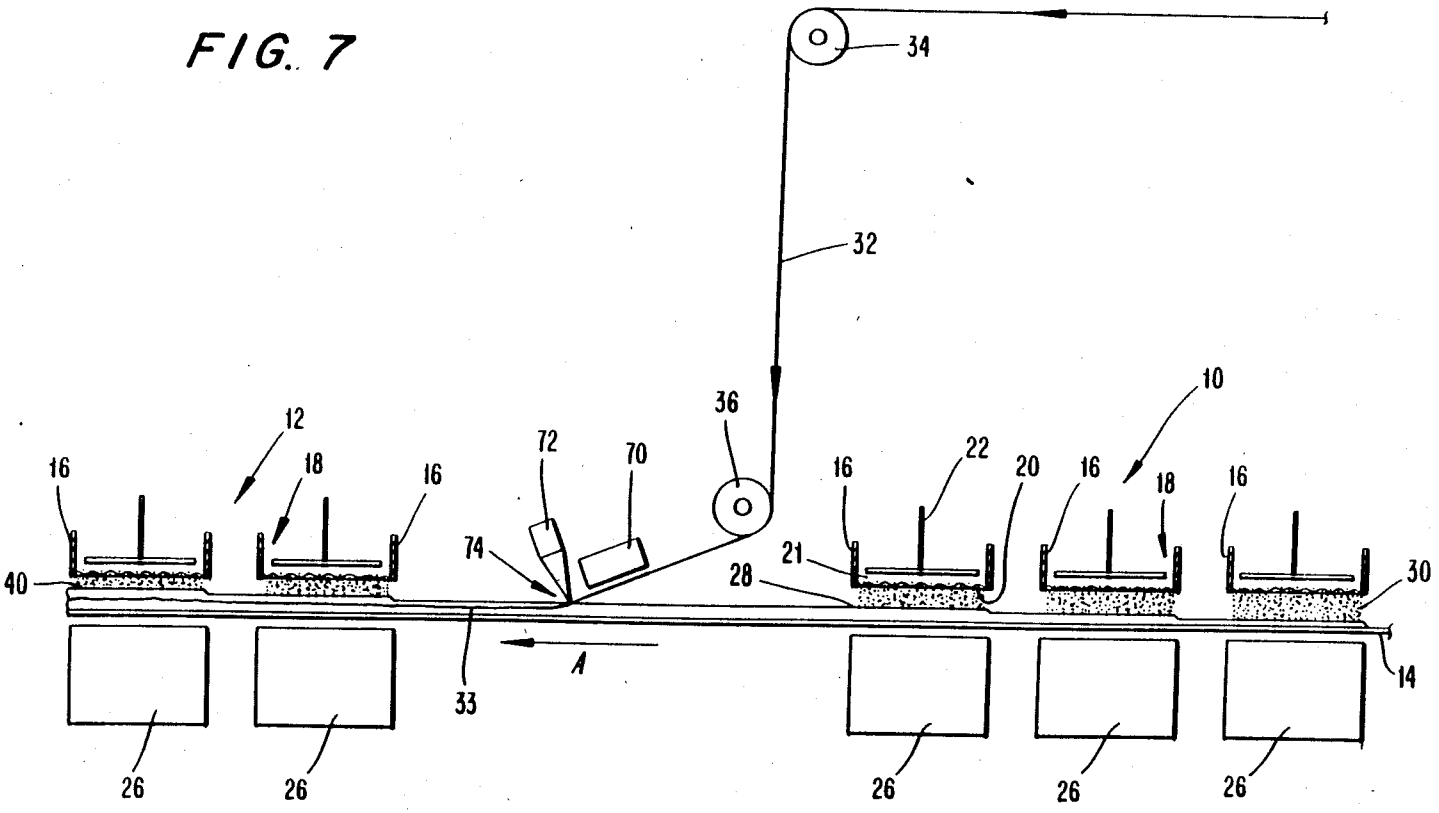
FIG. 7 is a schematic view of still another embodiment of the method and apparatus of the present invention.

Various other embodiments of the present method are shown in FIGS. 5–7. In FIGS. 5–7, parts that are the same as or similar to the parts shown in FIGS. 1 and 2 are similarly numbered.

In the embodiment shown in FIG. 5, an additional pair of rollers 60 is provided to form a nip 62 through which the yarns 32 are fed as they are applied to the first layer 28 of dry cellulosic fibers. By this arrangement of rollers 60, a relatively greater tension is maintained on the yarn 32, as compared with the tension afforded by the single roller 38 of the embodiment shown in FIG. 1. Moreover, by maintaining greater tension on the yarn 32 prior to laydown, a greater difference in tension on the yarns before and after laydown is achieved. This greater difference between the tension placed on the yarns prior to application and the relaxed condition of the yarns after application to the first layer 28 of dry cellulosic fibers increases the relaxed condition and bulk of the yarns 33 in the resulting web 42.

In the embodiment shown in FIG. 6, a heating means, such as a heater 70, is positioned along an area 71 in which the yarn 32 is maintained under tension prior to application to the first layer 28 of dry cellulosic fibers. The heated yarns 32 under tension are then drawn over a sharp edge 72, such as the edge of a knife. The sharp edge 32 can replace one of the pulleys 36 used in the embodiment of FIG. 1 to maintain tension on the yarns 32.

The heating and drawing of the yarns 32 over the sharp edge 72 causes the yarn filaments to spread. The yarns are heated and drawn in an amount sufficient to cause this spreading. As a result, the yarns have a tendency to curl after the release of the tension on the yarns. This spreading and curling further increases the bulk of the yarns 33 and, hence, the absorbency of the resulting web product.

In the embodiments shown in FIG. 7, the yarns 32 are also heated by a heater 70 and drawn over a sharp edge 72 prior to application to the first layer 28 of dry cellulosic fibers. The sharp edge 72 and heater 70 in the embodiment of FIG. 7 is provided at a point 74 at which the yarns 32 initially touch the first layer 28 of dry cellulosic fibers. This close positioning of the heater 70 and the sharpe edge 72 at the point 74 in close proximity to the first layer 28 of dry cellulosic fibers avoids the cooling of the yarns 32 while they are under tension prior to application to the first layer 28 of dry cellulosic fibers. In contrast, in the embodiment shown in FIG. 6, the sharp edge 72 is located in the area 71 slightly away from the point 74 and, thus, the yarns 32 may cool somewhat before they are applied to the first layer 28.

In accordance with the present invention, a reinforced dry laid fibrous web product is produced. The reinforced dry laid fibrous web comprises one or more layers of dry cellulosic fibers and a plurality of relaxed, bulked yarns dispersed within the layers of the dry cellulosic fibers to reinforce the strength of the layers and to increase the absorbency of the web.

Figure 3:
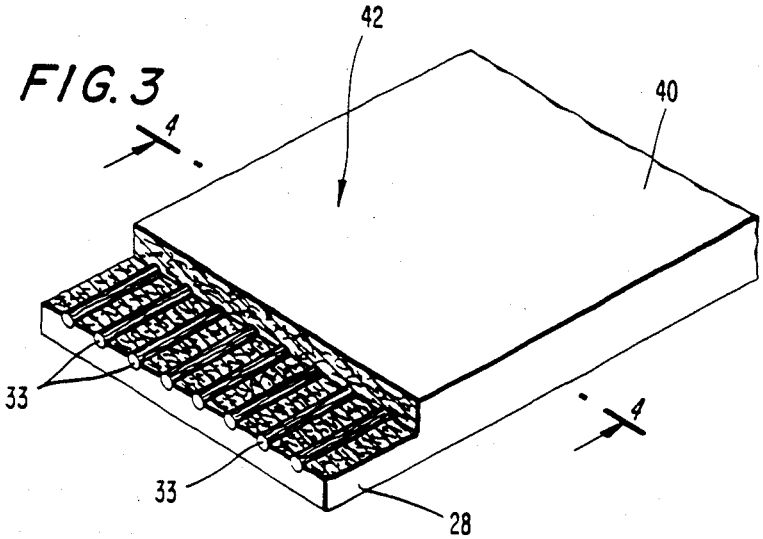
FIG. 3 is a perspective, cut-away view of a reinforced, dry laid fibrous web product of the present invention.
Figure 4:
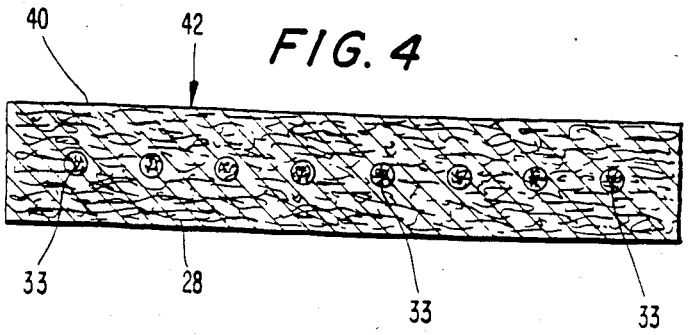
FIG. 4 is a sectional view of the web of FIG. 3 taken along line 3—3.

As embodied herein and shown in FIGS. 3 and 4, the reinforced dry laid fibrous web 42 of the present invention comprises one or more layers 28 and 40 of dry cellulosic fibers. A plurality of relaxed, bulked yarns 33 are dispersed within the layers 28 and 40 of dry cellulosic fibers to reinforce the strength of the layers 28 and 40 and to increase the absorbency of the web 42.

Preferably, the relaxed, bulked yarns 33 are spaced at a density of from about 4 per inch to about 12 per inch, in the cross machine direction, within the layers 28 and 40 of the dry cellulosic fibers. Such a spacing of yarn typically imparts to the finished web product 42 the desired degree of bulk, strength, and stretchability. However, other dimensions of the yarns, layers, and webs can be selected by the skilled artisan without undue experimentation.

In accordance with the present invention, an apparatus for making reinforced dry laid fibrous webs is provided. A means lays a first layer of dry cellulosic fibers on a forming wire means. As embodied herein and shown in FIG. 1, the means for laying a first layer of dry cellulosic fibers includes the first set 10 of dry fiber distributors 16. As embodied herein and shown in FIG. 1, the forming wire means includes the forming wire 14.

In accordance with the present invention, a means applies a plurality of yarns maintained under tension to the first layer of dry cellulosic fibers. As embodied herein and shown in FIG. 1, the applying means is one or more pulleys 34 and 36 and one or more rollers 38 that apply a plurality of yarns 32 maintained under tension to the first layer 28 of dry cellulosic fibers.

In accordance with the present invention, a means releases the tension on the bulk yarns upon application to the first layer of dry cellulosic fibers to form relaxed, bulked yarns. As embodied herein and shown in FIGS. 1 and 2, the releasing means is a roller 38 and forming wire 14 that are operated at a linear speed slightly slower than the speed of the pulleys 34 and 36 maintaining the yarns 32 under tension.

In accordance with the present invention, a means lays a second layer of dry cellulosic fibers onto the first layer of dry cellulosic fibers and applied yarns. As embodied herein and shown in FIG. 1, the laying means is a second set 12 of fiber distributors 16 that lay a second layer 40 of dry cellulosic fibers on the first layer 28 of dry cellulosic fibers and relaxed, bulked yarns 33.

The apparatus of the present invention can also include various means to heat the yarns under tension. As embodied herein and shown in FIGS. 6 and 7, the heating means is a heater 70 that is positioned adjacent to the yarns 32 while they are maintained under tension by the pulleys 34 and 36. The yarns are heated to a temperature sufficient to spread the yarns.

The apparatus of the present invention can also include an edge means that spreads the yarns maintained under tension prior to application of the yarns to the first layer. As embodied herein and shown in FIGS. 6 and 7, the edge means is a sharp edge 72, such as a knife, that is positioned adjacent to the yarns 32 while they are maintained under tension by the pulleys 34 and 36 prior to application to the first layer 28 of dry cellulosic fibers. The sharp edge 72 can be positioned either in an area 71 remote from the application of the yarns 32 to the first layer 28 or at the point 74 that is in close proximity to the first layer 28 of cellulosic fibers.

It will be apparent to those skilled in the art that various other modifications and variations could be made in the present invention without departing from the scope and content of the invention.

What is claimed is:

1. A reinforced, dry laid fibrous web comprising:

(a) one or more layers of dry cellulosic fibers; and (b) a plurality of relaxed, bulked yarns dispersed within the layers of the dry cellulosic fibers to reinforce the strength of the layers and to increase the absorbency of the web.

2. The web of claim 1, wherein the relaxed, bulked yarns are made of a polymeric material.

3. The web of claim 2, wherein the polymeric material is selected from the group consisting of polypropylene, polyamide, polyester, polyhydrocarbon, polyurethane, polycarbonate polyacetal, polyacrylic, polyvinyl, polyvinylidene, polyaramid, nylon, and rayon.

4. The web of claim 3, wherein the polymeric material has a melting point greater than about 300° F.

5. The web of claim 1, wherein the polymeric material is a polyaramid fiber.

6. The web of claim 1, wherein the plurality of relaxed, bulked, yarns are substantially parallel to each other.

7. The web of claim 1, wherein the relaxed, bulked yarns are spaced at a density in the range of about 4 per inch to about 12 per inch in the cross machine direction of the layers.

8. The web of claim 1, wherein the relaxed, bulked yarns have about 50 to 60 filaments per yarn strand, the filaments on average being about 70 to 100 denier.

* * * * *